United States Patent [19]

Segawa et al.

[11] 4,253,800

[45] Mar. 3, 1981

[54] WHEEL OR ROTOR WITH A PLURALITY OF BLADES

[75] Inventors: Yorihide Segawa, Hitachi; Fumio Fujisawa, Mito; Koki Shiohata, Hitachi, all of Japan

[73] Assignee: Hitachi, Ltd., Tokyo, Japan

[21] Appl. No.: 65,534

[22] Filed: Aug. 10, 1979

[30] Foreign Application Priority Data

Aug. 12, 1978 [JP] Japan ..... 53-97788

[51] Int. Cl.[3] ..... F04D 29/66

[52] U.S. Cl. ..... 416/203; 415/119; 416/500

[58] Field of Search ..... 416/203, 500; 415/119, 415/181

[56] References Cited

U.S. PATENT DOCUMENTS

| | | | |
|---|---|---|---|
| 1,893,184 | 1/1933 | Smellie | 416/203 X |
| 3,006,603 | 10/1961 | Caruso et al. | 416/203 X |
| 3,398,866 | 8/1968 | LaFlame et al. | 416/203 X |
| 3,426,535 | 2/1969 | Mlacker et al. | 416/203 X |
| 3,536,417 | 10/1970 | Stiefel et al. | 416/203 X |
| 3,764,225 | 10/1973 | Dzung | 416/203 X |

FOREIGN PATENT DOCUMENTS

| | | | |
|---|---|---|---|
| 568402 | 1/1933 | Fed. Rep. of Germany | 416/203 |
| 2524555 | 12/1975 | Fed. Rep. of Germany | 416/203 |
| 1012041 | 7/1952 | France | 416/203 |
| 1293553 | 10/1972 | United Kingdom | 416/203 |
| 1523884 | 9/1978 | United Kingdom | 416/203 |

*Primary Examiner*—Everette A. Powell, Jr.
*Attorney, Agent, or Firm*—Craig and Antonelli

[57] ABSTRACT

A wheel or rotor with a plurality of blades arranged at irregular or unequal pitch angles circumferentially of a disk, a hub or the like, wherein the characteristic level $e_k$ representative of the order-of-harmonic characteristic of blade pitch is defined by $$e_k = 10 \log_e d_k + 100$$

where $$d_k = \frac{1}{Z}\sqrt{\left(\sum_{j=1}^{Z} \cos k\theta_j\right)^2 + \left(\sum_{j=1}^{Z} \sin k\theta_j\right)^2}$$

Z = a number of blades k = 1,2, . . . and n; n ≧ Z $\theta_j$ = the angular position of the tip or root of each blade defined in terms of a central angle subtended at the center of a circle, which is the axis of said wheel or rotor, by an arc extended from a reference point on said circle to said tip or root of each blade on said circle, j = 1,2, . . . and Z; and the characteristic level $e_k$ satisfies the following conditions $$\begin{cases} 35 < e_1 < 65 \\ e - 7 < e_k < e + 7 \end{cases}$$

where $e = -13.14 \log_{10} Z + 99.70$ k = 2,3, . . . n.

1 Claim, 8 Drawing Figures

WHEEL OR ROTOR WITH A PLURALITY OF BLADES

BACKGROUND OF THE INVENTION

1. FIELD OF THE INVENTION

The present invention relates to fan wheels of centrifugal and axial fans such as blowers, exhaust fans and the like, impellers of pumps, steam and gas turbine rotors and fan wheels attached to generators and motors for cooling them and more particularly wheels or rotors with a plurality of blades especially adapted for use in rotary machines which must be operated with less noise and less vibrations.

2. BRIEF DESCRIPTION OF THE PRIOR ART

When a fan wheel is rotated, the noise is produced from the fan wheel itself or from a machine incorporating the fan wheel. Most unpleasant is the fan noise associated with the number of blades. In order to control the fan noise, there has been proposed a fan wheel or the like wherein a plurality of blades are arranged at irregular or unequal pitch angles. However the irregular or unequal pitch angles have been determined mainly in dependence upon the intuition and no satisfactory theory has been established which may obtain an optimum set of irregular or unequal pitch angles of blades so that the fan noise may be suppressed to a minimum level. In addition, the irregular or unequal pitch angle arrangement of blades inevitably gives rise to the inherent problem how to attain the mechanical balance of the fan wheel at the same time. Again so far no satisfactory theory to solve this problem has been proposed yet.

For instance, consider a blade arrangement wherein 12 blades are divided into four sets each consisting of three blades spaced equiangularly and the adjacent sets are circumferentially spaced apart from each other by a suitable angle, whereby the blades may be arranged at irregular or unequal pitch angles. This arrangement serves to attain the mechanical balance of the fan wheel, but will not suppress the unpleasant fan noise sufficiently because each set of three blades would act as an equally pitched fan. Thus it has been extremely difficult to attain a compromise between the irregular or unequal pitch angle arrangement of blades and the attainment of satisfactory mechanical balance of the fan wheel.

SUMMARY OF THE INVENTION

Accordingly, the primary object of the present invention is to provide a wheel or rotor with a plurality of blades arranged at irregular or unequal pitch angles circumferentially of a disk, a hub or the like which may substantially overcome the above and other problems encountered in the prior art, whereby the operation with less noise and less vibrations may be ensured.

To the above and other ends, the present invention provides a wheel or rotor with a plurality of blades arranged at irregular or unequal pitch angles circumferentially of a disk, a hub or the like, wherein the characteristic level $e_k$ representative of the order-of/ harmonic characteristic of blade pitch is defined by $$e_k = 10 \log_e d_k = 100 \tag{1}$$

where $$d_k = \frac{1}{Z}\sqrt{\left(\sum_{j=1}^{z} \cos k\theta_j\right)^2 + \left(\sum_{j=1}^{z} \sin k\theta_j\right)^2} \tag{1'}$$

z = a number of blades k = 1,2, . . . and n; $n \geqq Z$ $\theta_j$ = the angular position of the tip or root of each blade defined in terms of a central angle subtended at the center of a circle, whose center coincides with the axis of the wheel or rotor and on which all the tips or roots of the blades are positioned, by an arc extended from a reference point on said circle to said tip or root of each blade, j = 1,2, . . . and Z; and the characteristic level $e_k$ satisfies the following conditions $$\begin{cases} 35 < e_1 < 65 & (2) \\ e - 7 < e_k < e + 7 & (3) \end{cases}$$

where $$e = -13.14 \log_{10} Z + 99.70 \tag{4}$$

K = 2,3, . . . n $d_k$ obtained from Eq. (1') represents the magnitude of an order component obtained by the analysis of rotation order ratios of impulse signals generated at a point near to the path of the tips of blades of a fan wheel when the latter is rotated at a steady rotational speed. Eq. (1) represents the magnitude of the order component $d_k$ in terms of dB. The constant 100 in Eq. (1) is arbitrarily selected so as to facilitate to handle or process the characteristic level $e_k$. It follows therefore that the constant is not limited to 100, but any suitable values may be selected, but the values 35 and 65 in Eq. (2) as well as the constant 99.70 in Eq. (4) must be incremented or decremented depending upon a newly selected constant in Eq. (1).

Eq (2) must be satisfied in order to attain a satisfactory mechanical balance of the fan wheel in practice even though the blades are arranged at irregular or unequal pitch angles. Eq. (3) must be satisfied in order to flatten the frequency characteristic curve of the fan noise and to reduce the level of the fan noise. Eq. (4) is an empirical equation obtained from the extensive calculations and experiments conducted by the inventors.

According to the present invention, the noise from a fan wheel or the like and/or a machine incorporating a fan wheel or the like may be considerably suppressed. In addition, even though the blades are arranged at irregular or unequal pitch angles, an almost perfect mechanical balance may be ensured so that mechanical vibrations may be suppressed to a minimum.

The above and other objects, features and advantages of the present invention will become more apparent from the following description of some preferred embodiments thereof taken in conjunction with the accompanying drawings.

DESCRIPTION OF THE PREFERRED EMBODIMENTS

Figure 1:
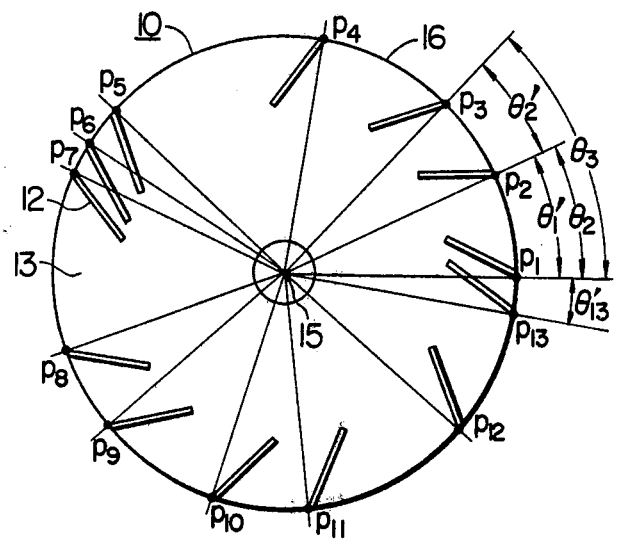
FIG. 1 is a schematic front view of a fan wheel which is a first embodiment of the present invention.
Figure 2:
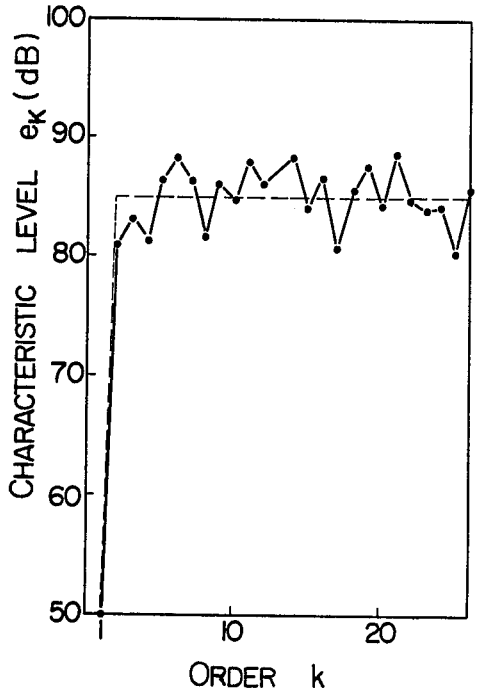
FIG. 2 shows the order characteristic of the blade pitch thereof.

First Embodiment, FIGS. 1 and 2

In FIG. 1 is shown a first embodiment of the present invention which is applied to a fan wheel for cooling an AC generator of an automotive vehicle. The fan is a centrifugal turbofan. A fan wheel 10 comprises a disk 13 and a plurality (13 in this embodiment) of blades 12 arranged at irregular or unequal pitch angles circumferentially of the disk 13. The blades 12 are straight in cross section.

The radially outward ends; that is, the roots of the blades 12 are located at points $p_1$, $p_2$, . . . and $p_{13}$ on a circle 16 whose center is the axis 15 of the fan wheel 10. The pitch angles of the blades 12 are expressed in terms of the central angles $\theta_1'$, $\theta_2'$, . . . , and $\theta'_{13}$ subtended at the center 15 of the circle 16 by arcs $p_1p_2$, $p_2p_3$, . . . and $p_{13}p_1$, respectively. In the first embodiment, the pitch angles are $\theta'_1=26.0°$, $\theta'_2=21.1°$, $\theta'_3=34.2°$, $\theta'_4=57.5°$, $\theta'_5=8.5°$, $\theta'_6=8.4°$, $\theta'_7=46.3°$, $\theta'_8=18.8°$, $\theta'_9=31.7°$, $\theta'_{10}=24.1°$, $\theta'_{11}=42.7°$, $\theta'_{12}=32.3°$ and $\theta'_{13}=8.4°$. In order to determine the angular positions $\theta_1$, $\theta_2$, $\theta_3$ . . . $\theta_{13}$ of the blades any point on the circle 16 may be selected as a reference point, but in the first embodiment shown in FIG. 1, the point $p_1$ is selected as a reference point. Therefore, $\theta_1=0°$, $\theta_2=\theta_1'$, $\theta_3=\theta_1+\theta'_2$ ans so on. The order-of-harmonic characteristic of the blade pitch of the fan wheel 10 is shown in FIG. 2.

The fan wheel 10 with the above proportions has the blade angular positions $\theta_1$, $\theta_2$, $\theta_3$ . . . and $\theta_{13}$ which satisfy Eq. (2) and Eq. (3), because when $Z=13$, $e=85.1$ dB from Eq. (4). That is, the fan wheel 10 is mechanically well balanced. Furthermore the blade noise may be considerably suppressed in unpleasant quality and sound pressure level. Experiments show that when the prior art fan wheel with irregular or unequal blade pitches for an AC generator is replaced with the fan wheel of the proportion described above, the fan noise is reduced by about two phones at a position spaced apart by 30 cm from the generator.

The first embodiment may ensure the reduction in fan noise in the order of harmonics from 1st to 26th. In order to attain a further suppression of fan noise, the highest order n may be further increased and the pitch angles of the blades may be obtained which satisfy Eqs. (2) and (3). It is possible to obtain such pitch angles by making calculations.

Figure 3:
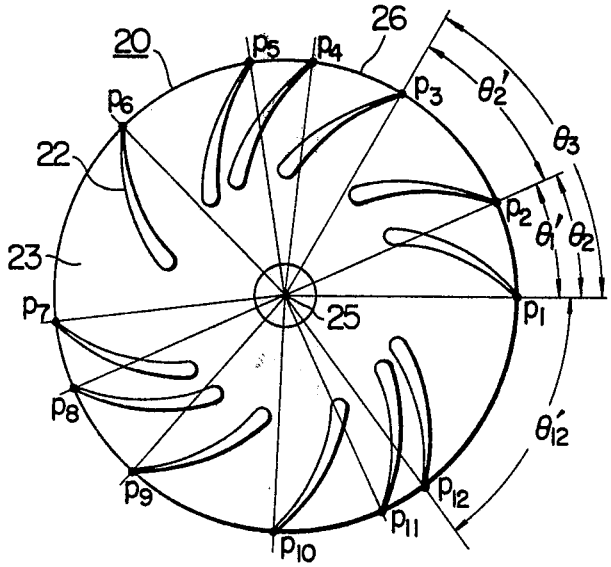
FIG. 3 is a schematic front view of an impeller which is a second embodiment of the present invention.
Figure 4:
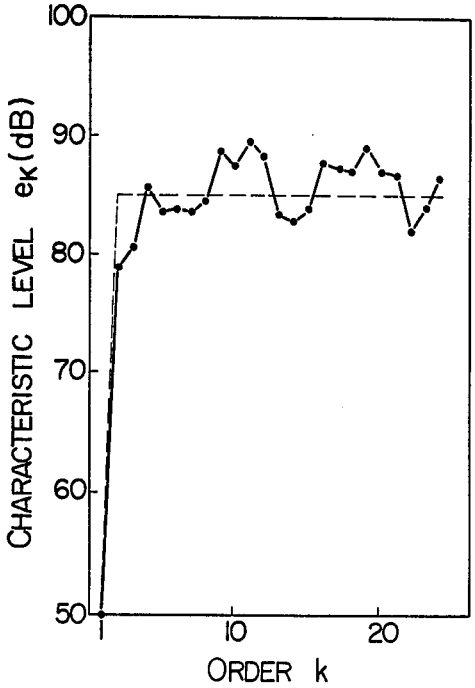
FIG. 4 shows the order characteristic of the blade pitch thereof.

Second Embodiment, FIGS. 3 and 4

In FIG. 3 is shown a second embodiment of the present invention which is applied to an impeller of a centrifugal pump. An impeller 20 comprises a disk 23 and twelve blades 22 arranged at irregular or unequal pitch angles circumferentially of the disk 23. The radially outward ends of the blades 22 are located at points $p_1$, $p_2$, . . . and $p_{12}$ on a circle 26 whose center is the axis 25 of the impeller 20. As with the first embodiment, the pitch angles are defined by the central angles $\theta_1'$, $\theta_2'$, . . . and $\theta'_{12}$ subtended at the center 25 of the circle 26 by the arcs $p_1p_2$, $p_2p_3$, . . . , and $p_{12}p_1$. That is, $\theta'_1=25.7°$, $\theta'_2=37.1°$, $\theta'_3=23.9°$, $\theta'_4=13.0°$, $\theta'_5=36.8°$, $\theta'_6=51.0°$, $\theta'_7=17.0°$, $\theta'_8=25.4°$, $\theta'_9=38.1°$, $\theta'_{10}=29.4°$, $\theta'_{11}=9.8°$ and $\theta'_{12}=52.0°$. The reference point of the blade angular positions $\theta_1$, $\theta_2$, . . . and $\theta_{12}$ is the point $p_1$ and consequently the blade angular positions are $\theta_1=0°$, $\theta_2=\theta'_1$, $\theta_3=\theta'_1+\theta'_2$ and so on as with the case of the first embodiment. The order-of-harmonic characteristic of the blade pitch of the impeller 20 is shown in FIG. 4.

The blade angular positions $\theta_1$, $\theta_2$, . . . and $\theta_{12}$ of the impeller 20 also satisfy Eq. (2) and Eq. (3), because when $Z=12$, $e=85.5$ dB from Eq. (4). The impeller 20 is mechanically well balanced. Furthermore, pulsations in hydraulic pressure due to the rotation of the impeller 20 may be reduced so that the sound pressure level of the vibration noise due to the liquid column vibration in the piping of the pump may be reduced.

Figure 5:
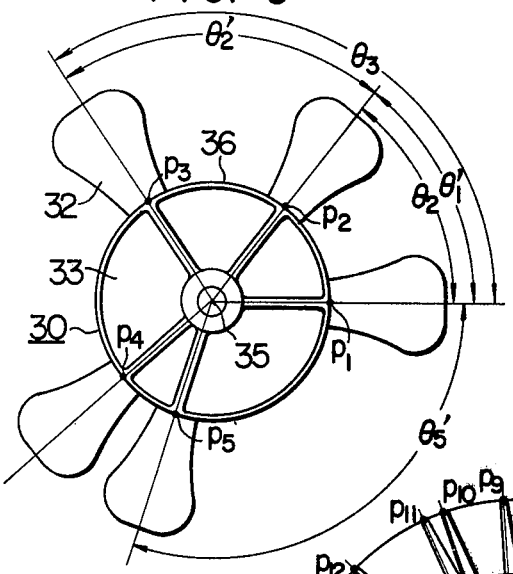
FIG. 5 is a schematic front view of an exhaust fan which is a third embodiment of the present invention.
Figure 6:
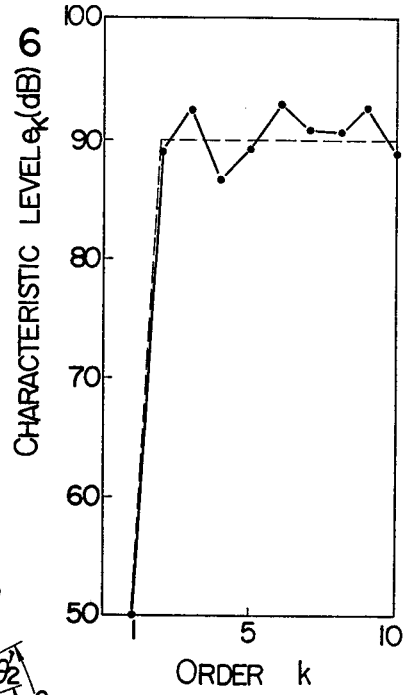
FIG. 6 shows the order characteristic of the blade pitch thereof.

Third Embodiment, FIGS. 5 and 6

In FIG. 5 is shown a third embodiment of the present invention which is applied to an exhaust fan with a large volume. The exhaust fan is an axial or propeller fan and has a fan wheel 30 comprising a disk 33 and five blades 32 arranged at irregular or unequal pitch angles circumferentially of the disk 33. The middle points of the radially inward ends of the blades 32 are located at points $p_1$, $p_2$ . . . $p_5$ on a circle 36 whose center is the axis of 35 of the fan wheel 30. The pitch angles of the blades 32 are also defined in terms of the central angles $\theta_1'$ through $\theta'_5$ subtended at the center 35 of the circle 36 by the arcs $p_1p_2$ through $p_5p_1$. That is, $\theta'_1=52.5°$, $\theta'_2=71.2°$, $\theta'_3=96.8°$, $\theta'_4=31.3°$ and $\theta'_5=108.2°$. The reference point to the blade angular positions $\theta_1$ through $\theta_5$ is also the point $p_1$. Therefore the blade angular positions are also defined as $\theta_1=0°$, $\theta_2=\theta_1'$, $\theta_3=\theta_1'+\theta_2'$ and so on. The order-of-harmonic characteristic of the blade pitch of the fan wheel 30 is shown in FIG. 6.

The blade angular positions $\theta_1$, $\theta_2$ . . . $\theta_5$ of the fan wheel 30 also satisfy Eq. (2) and Eq. (3), because when $Z=5$, $e=90.5$ dB from Eq. (4). The fan wheel 30 is mechanically well balanced. Furthermore the fan noise is considerably suppressed in both sound pressure level and unpleasant quality. The third embodiment may ensure the fan noise suppression from the first order to the 10th order of harmonics. The suppression of the fan noise at higher orders of harmonics (higher than the 10th) will become rather difficult, because a small number, five, of blades 32 will result in complex calculations in obtaining the blade pitch angles.

Figure 7:
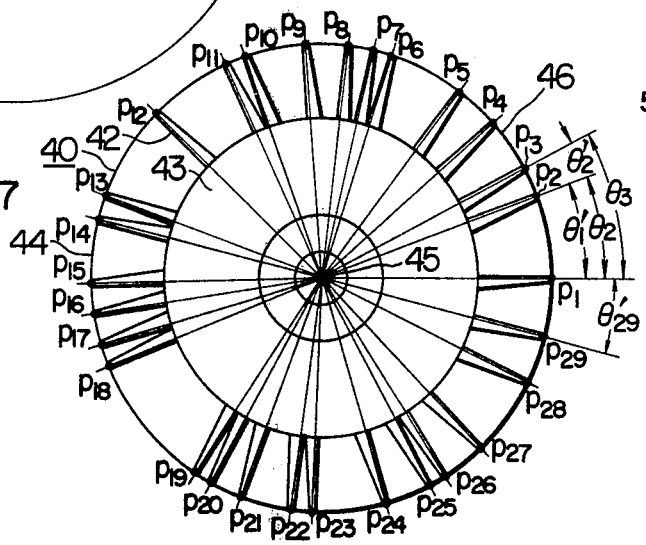
FIG. 7 is a schematic front view of a turbine wheel or rotor which is a fourth embodiment of the present invention.
Figure 8:
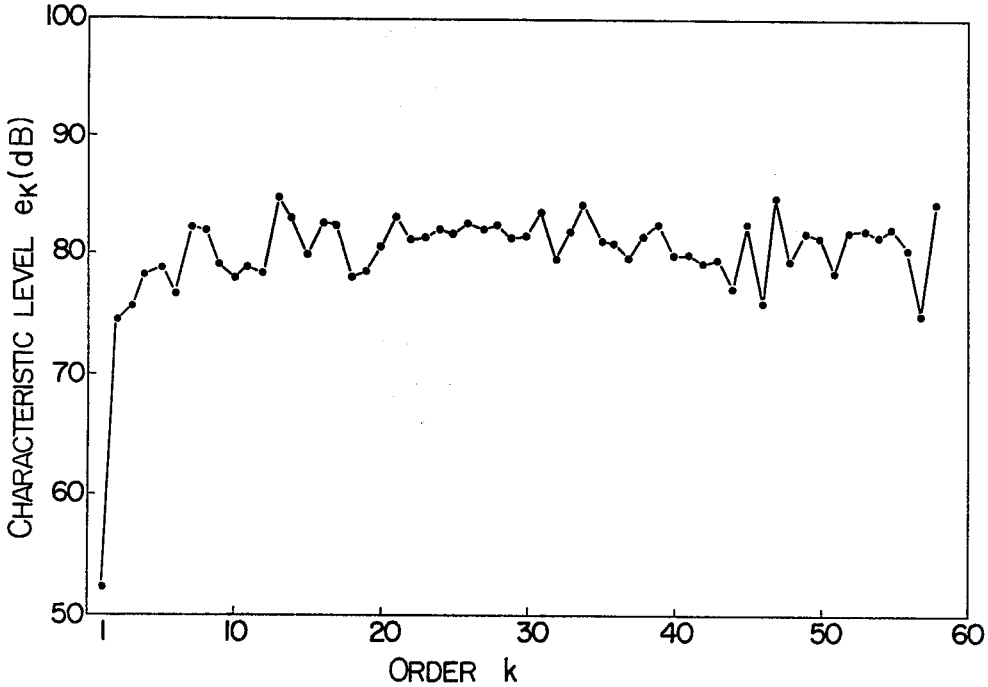
FIG. 8 shows the order characteristic of the blade pitch thereof.

Fourth Embodiment, FIGS. 7 and 8

In FIG. 7 is shown a fourth embodiment of the present invention which is applied to a rotor or wheel of a gas turbine or a steam turbine. A turbine wheel 40 comprises a hub 43 and 29 radial blades 42 arranged at irregular or unequal pitch angles circumferentially of the hub 43. The tips of the blades 42 are retained by a retaining ring 44. The tips of the blades 42 are attached to the ring 44 at points $p_1$ through $p_{29}$ on a circle 46 whose center is the axis 45 of the turbine wheel 40. The pitch angles of the blades 42 are also defined by the central angles $\theta_1'$ through $\theta_{29}'$ subtended at the center 45 of the circle 46 by the arcs $p_1p_2$ through $p_{29}p_1$, respectively. In the fourth embodiment, $\theta'_1=21.2°$, $\theta_2'=7.2°$, $\theta'_3=13.6°$, $\theta'_4=11.0°$, $\theta'_5=18.9°$, $\theta'_6=4.6°$, $\theta'_7=6.5°$, $\theta'_8=10.9°$, $\theta'_9=14.4°$, $\theta'_{10}=4.0°$, $\theta_{11}'=23.3°$, $\theta_{12}'=23.7°$, $\theta_{13}'=5.5°$, $\theta_{14}'=17.5°$, $\theta_{15}'=7.0°$, $\theta_{16}'=7.8°$, $\theta_{17}'=4.5°$, $\theta_{18}'=35.8°$, $\theta_{19}'=4.0°$, $\theta_{20}'=8.8°$, $\theta_{21}'=11.5°$, $\theta_{22}'=5.8°$, $\theta_{23}'=18.5°$, $\theta_{24}'=11.7°$, $\theta_{25}'=4.5°$, $\theta_{26}'=11.2°$, $\theta_{27}'=20.1°$, $\theta_{28}'=11.4°$ and $\theta_{29}'=15.1°$. The reference point for the blade angular positions $\theta_1$ through $\theta_{29}$ is also the point $p_1$ as with the first, second and third embodiments. Therefore, $\theta_1=0°$, $\theta_2=\theta'_1$, $\theta_3=\theta'_1+\theta_2'$ and so on. The order-of-harmonic characteristic of the blade pitch of the turbine wheel 40 is shown in FIG. 8.

The blade angular position $\theta_1$ through $\theta_{29}$ of the turbine wheel 40 may also satisfy Eq. (2) and Eq (3), because when Z=29, e=80.5 dB from Eq. (4). The turbine wheel 40 is mechanically well balanced. Furthermore, unpleasant periodic noise, whose period depends upon a number of blades 42, may be considerably suppressed. In addition, the sound pressure level of the turbine wheel noise may be also reduced.

The fourth embodiment may ensure the suppression of the noise from the first to the 58th order of harmonics. The suppression of noise higher than 58th may be attained rather easily because of a large number of blades 42.

So far the present invention has been described only in conjunction with the wheels with Z=5, 12, 13 and 29, but it will be understood that the present invention may be equally applied to a fan wheel or a turbine wheel with more than five blades.

What is claimed is:

1. A wheel or rotor with a plurality of blades arranged at irregular or unequal pitch angles circumferentially of a disk, a hub or the like characterized in that the characteristic level $e_k$ representative of the order-of-harmonic characteristic of blade pitch is defined by $$e_k=10\log_e d_k+100$$

where $$d_k=\frac{1}{Z}\sqrt{\left(\sum_{j=1}^{z}\cos k\theta_j\right)^2+\left(\sum_{j=1}^{z}\sin k\theta_j\right)^2}$$

z=a number of blades k=1,2, . . . and n; n≧Z $\theta_j$=the angular position of the tip or root of each blade defined in terms of a central angle subtended at the center of a circle, which is the axis of said wheel or rotor, by an arc extended from a reference point on said circle to said tip or root of each blade on said circle, j=1,2, . . . and Z; and said characteristic level $e_k$ satisfies the following conditions $$\begin{cases} 35 < e_1 < 65 \\ e-7 < e_k < e+7 \end{cases}$$

where $e=-13.14\log_{10}Z+99.70$ k=2,3, n.

* * * * *